US010705447B1

(12) United States Patent
Handa

(10) Patent No.: US 10,705,447 B1
(45) Date of Patent: Jul. 7, 2020

(54) IMAGE FORMING SYSTEM INCLUDING A FIRST TRANSFER UNIT AND A SECOND TRANSFER UNIT HAVING A TOTAL RESISTANCE LARGER THAN THAT OF THE FIRST TRANSFER UNIT

(71) Applicant: FUJI XEROX CO., LTD., Tokyo (JP)

(72) Inventor: Osamu Handa, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/540,531

(22) Filed: Aug. 14, 2019

(30) Foreign Application Priority Data

Mar. 22, 2019 (JP) ..... 2019-055216

(51) Int. Cl.
*G03G 15/16* (2006.01)
*G03G 15/02* (2006.01)

(52) U.S. Cl.
CPC ..... *G03G 15/0266* (2013.01); *G03G 15/0225* (2013.01); *G03G 15/0275* (2013.01); *G03G 2215/021* (2013.01)

(58) Field of Classification Search
USPC ..... 399/66
See application file for complete search history.

(56) References Cited

FOREIGN PATENT DOCUMENTS

JP 4604837 B2 * 1/2011
JP 4604837 B2 1/2011
JP 2011043708 A * 3/2011

OTHER PUBLICATIONS

Computer translation of JP2011-043708A to Terao, Mar. 2011 (Year: 2011).*

* cited by examiner

*Primary Examiner* — Quana Grainger
(74) *Attorney, Agent, or Firm* — Sughrue Mion, PLLC

(57) ABSTRACT

An image forming system includes first and second apparatuses. The first image forming apparatus includes a first image forming unit and a first transfer unit. The first image forming unit forms an image of at least one color. The first transfer unit transfers the formed image to a recording medium. The second image forming apparatus includes a second image forming unit and a second transfer unit. The second image forming unit forms an image different in at least a part of colors from the first image forming apparatus. The second transfer unit transfers the formed image to the recording medium on which the image has been formed by the first image forming apparatus. A total resistance of the second transfer unit along a direction in which a transfer current flows is larger than that of the first transfer unit.

13 Claims, 9 Drawing Sheets

IMAGE FORMING SYSTEM INCLUDING A FIRST TRANSFER UNIT AND A SECOND TRANSFER UNIT HAVING A TOTAL RESISTANCE LARGER THAN THAT OF THE FIRST TRANSFER UNIT

CROSS-REFERENCE TO RELATED APPLICATIONS

This application is based on and claims priority under 35 USC 119 from Japanese Patent Application No. 2019-055216 filed Mar. 22, 2019.

BACKGROUND

(i) Technical Field

The present disclosure relates to an image forming system.

(ii) Related Art

In the related art, a technique related to an image forming system including plural print engines has been proposed, for example, as disclosed in JP-B-4604837.

JP-B-4604837 discloses a printer including plural print engines and a print control unit, the print engines printing color images using process color printing units, which uses a process color marking material, and spot color printing units, which uses a spot color marking material having a different color from the process color and the print control unit distributing print manuscript image data to the plural print engines such that the print engines perform printing. The spot colors used in the spot color printing units are different at different print engines. The print control unit calculates, as matching degrees, the number of pixels having color values within a predetermined distance to the spot color used at the spot color printing unit of the print engine in a color space, among pixels of print manuscript image data, for each print engine, and causes the print engine with the highest matching degree to print the print document image data.

SUMMARY

Aspects of non-limiting embodiments of the present disclosure relates to improving transferability when a second image forming apparatus transfers an image to a recording medium on which an image has been formed by a first image forming apparatus, as compared with a case where a total resistance of a transfer unit in the second image forming apparatus along a direction in which a transfer current flows is equal to or less than that of a transfer unit in the first image forming apparatus.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming system including: a first image forming apparatus including a first image forming unit configured to form an image of at least one color, and a first transfer unit configured to transfer the image formed by the first image forming unit to a recording medium; and a second image forming apparatus including a second image forming unit configured to form an image which is different in at least a part of colors from the first image forming apparatus, and a second transfer unit configured to transfer the image formed by the second image forming unit to the recording medium on which the image has been formed by the first image forming apparatus, in which a total resistance of the second transfer unit along a direction in which a transfer current flows is larger than that of the first transfer unit.

BRIEF DESCRIPTION OF THE DRAWINGS

Exemplary embodiment(s) of the present disclosure will be described in detail based on the following figures, wherein.

DETAILED DESCRIPTION

Hereinafter, exemplary embodiments of the present disclosure will be described below with reference to the drawings.

Exemplary Embodiment 1

Figure 1:
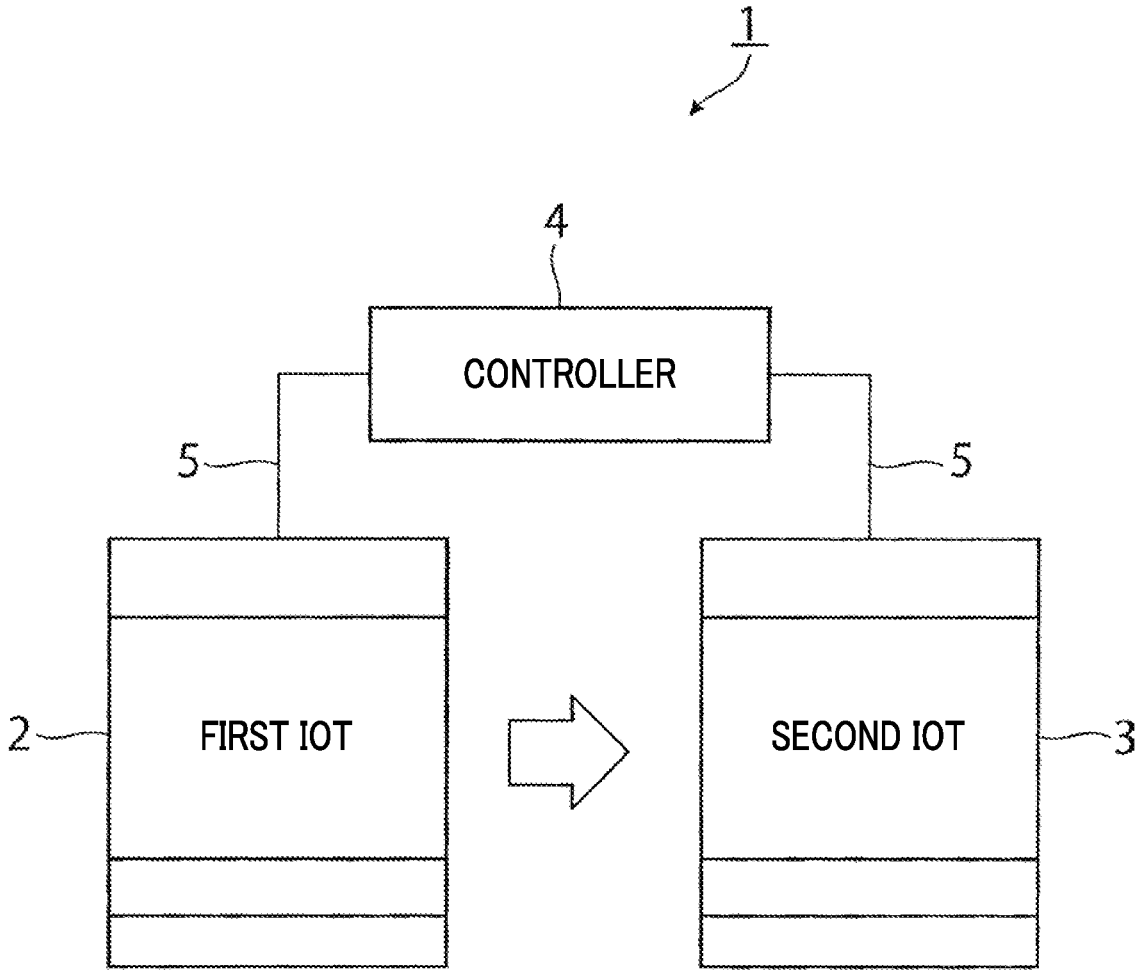
FIG. 1 is a schematic configuration diagram illustrating the entire image forming system according to an exemplary embodiment 1 of the present disclosure.
Figure 2:
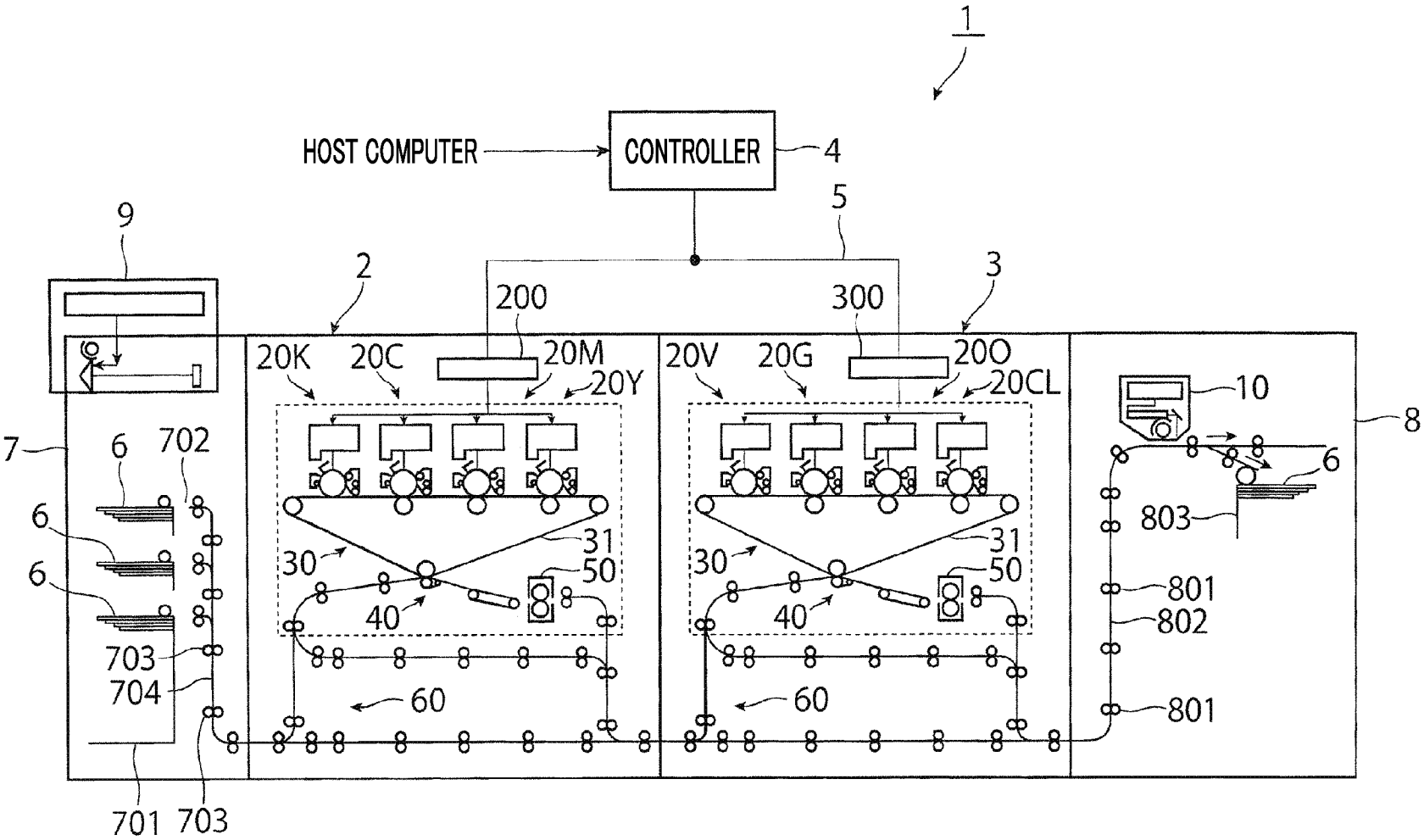
FIG. 2 is a configuration diagram illustrating the entire image forming system according to the exemplary embodiment 1 of the present disclosure.
Figure 3:
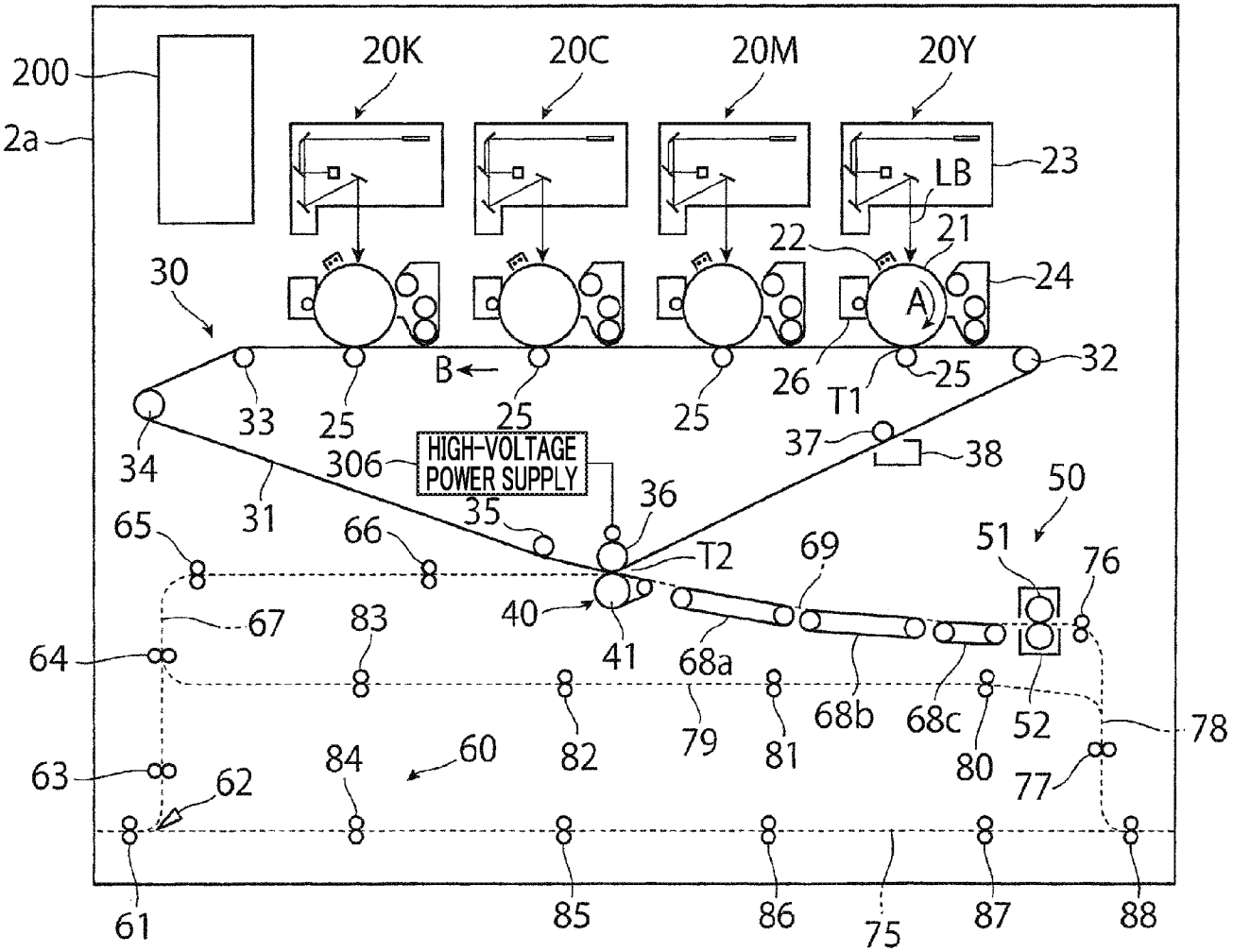
FIG. 3 is a configuration diagram illustrating a first image forming apparatus.
Figure 4:
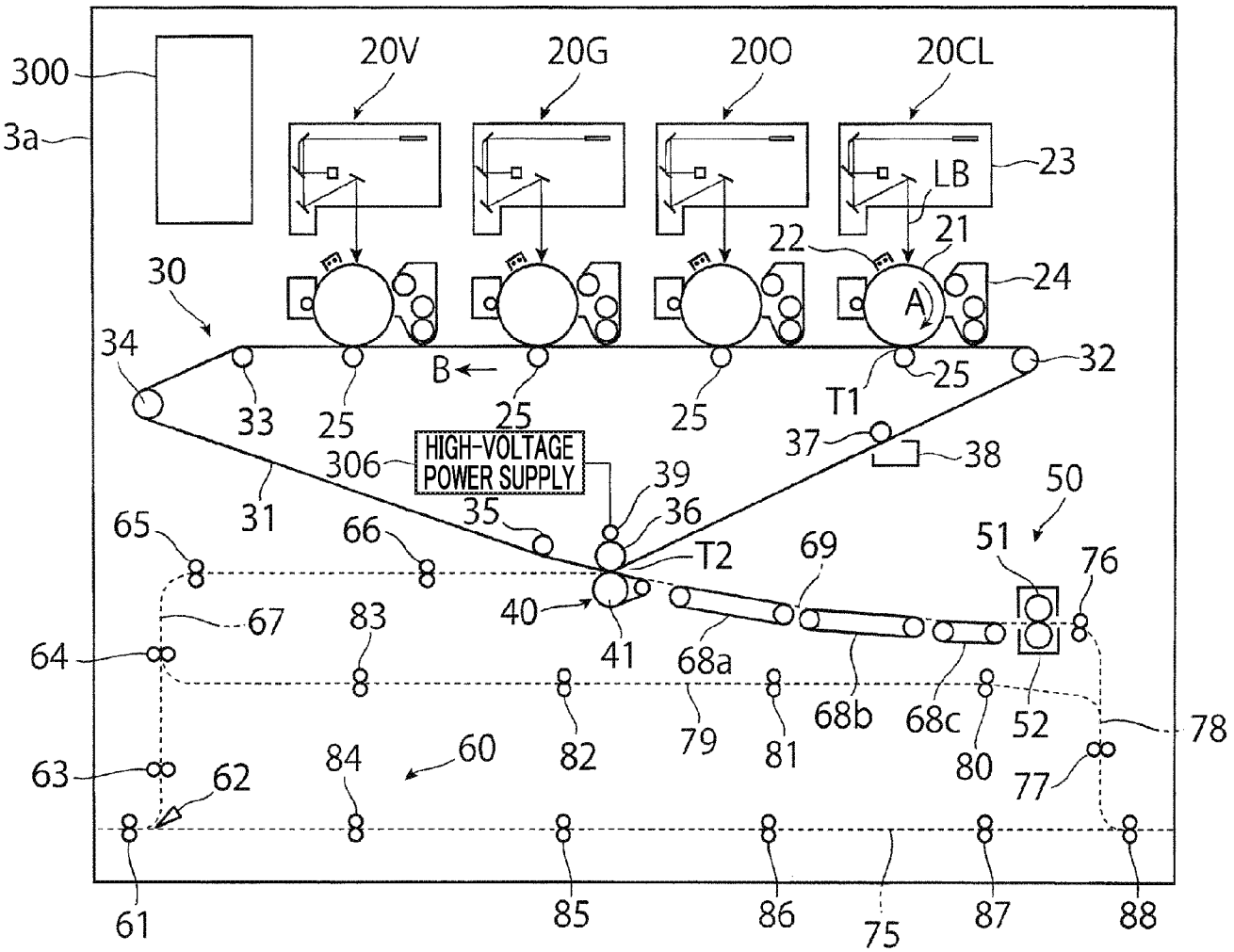
FIG. 4 is a configuration diagram illustrating a second image forming apparatus.

FIGS. 1 to 4 illustrate an image forming system according to an exemplary embodiment 1. FIGS. 1 and 2 illustrate an overview of the whole image forming system. FIG. 3 illustrates a configuration of a first image forming apparatus. FIG. 4 illustrates a configuration of a second image forming apparatus.

Configuration of Image Forming System

As illustrated in FIGS. 1 and 2, an image forming system 1 includes a sheet feeding device 7 that feeds a recording sheet 6 as an example of a recording medium, a first image forming apparatus 2 that forms an image on the recording sheet 6 fed from the sheet feeding device 7 with color toners of yellow (Y), magenta (M), cyan (C), and black (K), a second image forming apparatus 3 that forms an image on the recording sheet 6 on which the image has been formed by the first image forming apparatus 2, with spot color toners of transparent (CL), orange (O), green (G), violet (V), a sheet discharging device 8 that discharges the recording sheet 6 on which the images are formed by the first image forming apparatus 2 and the second image forming apparatus 3, and a controller 4 that controls the sheet feeding device 7, the first and second image forming apparatuses 2 and 3, and the sheet discharging device 8.

As the controller 4, for example, a server device is used. The server device is provided separately from the first and second image forming apparatuses 2 and 3. Image information to be formed in the first and second image forming apparatuses 2 and 3 is transmitted to the controller 4 from the host computer or the like (not illustrated). The first image forming apparatus 2, the second image forming apparatus 3 and the controller 4 are connected to each other via a communication line 5 so as to communicate with each other if necessary. The communication line 5 may be a local area network (LAN), a telephone line, the Internet, or the like. The first image forming apparatus 2 and the second image forming apparatus 3 are disposed in an office where a user works, or the like.

Here, the "spot color toner" mean toner of a color other than basic colors (also referred to as "process color") of yellow (Y), magenta (M), cyan (C), and black (K) which are usually used in the first image forming apparatus 2. Examples of the spot color toner includes white toner, metal color toner such as gold and silver, custom color and transparent toner, and foam toner. In addition, the custom color is a color generated as a single color other than so-called process color toner such as yellow (Y), magenta (M), cyan (C), and black (K). The custom colors includes a pastel color and a fluorescent color such as orange, green and blue.

As illustrated in FIG. 2, the sheet feeding device 7 is located on the left side of the first image forming apparatus 2. The sheet feeding device 7 includes a sheet transport path 704 that is provided with plural (or many) sheet accommodating bodies 701 that accommodates recording sheets 6 of desired size, type, and the like in a stacked state, a feeding device 702 that feeds the recording sheets 6 one by one from the sheet accommodating body 701, and a sheet transport roller pair 703 that transports the recording sheet 6 fed by the feeding device 702 to the first image forming apparatus 2. An image reading device 9 that reads an image of a document (not illustrated) is disposed on the sheet feeding device 7.

The sheet discharging device 8 is located on the right side of the second image forming apparatus 3. The sheet discharging device 8 includes a discharge and transport path 802 and plural (or many) discharging and accommodating units 803. The discharge and transport path 802 has sheet transport roller pairs 801 that transport the recording sheet 6 discharged from the second image forming apparatus 3. The discharging and accommodating units 803 accommodate the recording sheets 6 transported through the discharge and transport path 802. An image reading device 10 is disposed in the discharge and transport path 802. The image reading device 10 reads images formed on the recording sheet 6 by the first and second image forming apparatuses 2 and 3 to evaluate the image quality of the images.

Configuration of First Image Forming Apparatus

The first image forming apparatus 2 according to the exemplary embodiment 1 may be, for example, a color printer. As illustrated in FIG. 3, the first image forming apparatus 2 includes four image forming devices 20 arranged in a row in a horizontal direction in the internal space of an apparatus main body 2*a*. The image forming devices 20 are examples of a first image forming unit. The four image forming devices 20 are image forming devices 20Y. 20M. 20C, and 20K that exclusively form color toner images corresponding to colors of yellow (Y), magenta (M), cyan (C), and black (K), respectively.

The image forming devices 20 (Y, M, C, K) are basically configured in the same manner. Each of the image forming devices 20 (Y, M, C, K) includes a photoconductor drum 21 as an example of an image carrier that rotates along a direction indicated by an arrow A, a charging device 22 that charges a peripheral surface (image carrying surface) of the photoconductor drum 21 on which an image can be formed to a predetermined potential, an exposure device 23 as an example of an exposure unit that forms an electrostatic latent image (for respective colors) having a potential difference by applying light LB based on information on (signal of) the image to the charged circumferential surface of the photoconductor drum 21, a developing device 24 (Y, M, C, K) as an example of a developing unit that develops the electrostatic latent images with toner of a developer of a corresponding color (Y, M, C, K) to form a toner image, a primary transfer device 25 as an example of a primary transfer unit that transfer each toner image to an intermediate transfer device 30, a drum cleaning device 26 that removes and cleans up adhering matters such as toner remaining on the image carrying surface of the photoconductor drum 21 after the primary transfer, and the like. The broken lines in FIG. 3 indicate a main transport path along which the recording sheet 6 is transported in the apparatus main body 2*a*.

The intermediate transfer device 30 is disposed below the image forming devices 20 (Y, M, C, K). The intermediate transfer device 30 includes an intermediate transfer belt 31 as an example of an intermediate transfer unit that circulates in a direction indicated by an arrow B while passing through primary transfer positions T1 positioned under the photoconductor drums 21 of the image forming devices 20 (Y, M, C, K). At the primary transfer position T1, the primary transfer device 25 (primary transfer roller) is in contact with the circumferential surface of the photoconductor drum 21 via the intermediate transfer belt 31. A primary transfer bias voltage of a polarity opposite to the toner image on the photoconductor drum 21 is applied to the primary transfer device 25 by a high-voltage power supply (not illustrated). The intermediate transfer belt 31 is held by plural belt support rollers 32 to 37 from the inner periphery of the intermediate transfer belt 31 to be in a desired state and supported to be movable in a circulation manner. The plural belt support rollers 32 to 37 include a belt support roller 32 as a driving roller, belt support rollers 33 and 35 as driven rollers that hold a traveling position of the intermediate transfer belt 31 and the like, a belt support roller 34 as a tension imparting roller, a belt support roller 36 as a secondary transfer backup roller, and the belt support roller 37 as a support roller of a belt cleaning device 38.

The intermediate transfer belt 31 is, for example, an endless belt made of a single layer or two or more layers of a material in which resistance modifiers such as carbon black are dispersed in synthetic resin such as polycarbonate resin, polyimide resin, or polyamide-imide resin.

The intermediate transfer belt 31 has, for example, a thickness of 100 μm, a width of 300 to 350 mm, and a circumferential length of approximately 500 to 3000 mm. Further, the intermediate transfer belt 31 may have surface resistivities of the front and back surfaces of 10.5 to 12.5 Log Ω/□, and the volume resistivity of 11 to 13 Log Ω·cm.

A secondary transfer device 40 is disposed on the outer peripheral surface (image carrying surface) of the intermediate transfer belt 31 supported by the belt support roller 36. The secondary transfer device 40 is an example of a first transfer unit. The secondary transfer device secondarily transfers the toner image on the intermediate transfer belt 31 to the recording sheet 6. As the secondary transfer device 40, a contact-type transfer device is employed that includes the belt support rollers 36 which supports the intermediate transfer belt 31 at the secondary transfer position T2, and a secondary transfer belt 41 that rotates while being in contact with the outer peripheral surface of the intermediate transfer belt 31 supported by the belt support rollers 36. The belt cleaning device 38 is disposed downstream of the intermediate transfer belt 31 passing the secondary transfer device 40. The belt cleaning device 38 cleans the surface thereof by removing the toner, paper dust and the like adhering to the surface thereof. The secondary transfer device 40 will be described later in more detail.

As illustrated in FIG. 3, a fixing device 50 includes a heating rotational body 51 that is of a roller type or a belt type and that is heated by a heating unit (heat source) to maintain the surface temperature at a predetermined temperature, a pressure applying rotational body 52 that is of a roller type or a belt type and that rotates while being in contact with the heating rotational body 51 with a required pressure, and the like. In the fixing device 50, a contact portion between the heating rotational body 51 and the pressure applying rotational body 52 serves as a fixing processing unit that performs a fixing process (that is, applies heat and pressure).

In the apparatus main body 2*a* of the first image forming apparatus 2, a transport device 60 is provided that transports the recording sheet 6 fed from the sheet feeding device 7. The transport device 60 includes an introducing roller pair 61 that introduces the recording sheet 6 fed from the sheet feeding device 7 into the apparatus main body 2*a*, and a switching member 62 that is disposed downstream of the introducing roller pair 61 in a transport direction of the recording sheet 6 and that switches between an upward transport path along a vertical direction and a transport path along a horizontal direction.

The upward transport path along the vertical direction includes a sheet feeding transport path 67. The sheet feeding transport path 67 includes plural sheet transport roller pairs 63 to 66 that transport the recording sheet 6 to the secondary transfer position T2, and a transport guide member (not illustrated). The sheet transport roller pair 66 disposed at a position immediately before the secondary transfer position T2 in the sheet feeding transport path 67 is, for example, a roller (registration roller) that adjusts the transport timing of the recording sheet 6.

In addition, a sheet transport path 69 is provided between the secondary transfer device 40 and the fixing device 50, and has plural (or a single) sheet transport belts 68*a*, 68*b*, and 68*c* that transport the recording sheet 6 transported from the secondary transfer device 40 to the fixing device 50.

A discharge and transport path 78 is provided downstream of the fixing device 50. The discharge and transport path 78 has sheet discharge roller pairs 76 and 77 that transport the recording sheet 6 on which the toner image is fixed by the fixing device 50 to a discharge and transport path 75 disposed at a bottom portion of the apparatus main body 2*a*.

The discharge and transport path 78 also functions as an inverting transport path that inverts the recording sheet 6. In an intermediate position on the discharge and transport path 78, a switching member (not illustrated) is provided that switches the transport direction of the recording sheet 6. The sheet discharge roller pair 77 disposed at the discharge and transport path 78 is configured to be able to switch a rotation direction thereof between a forward rotation direction and a reverse rotation direction. A duplex transport path 79 that branches to the left from an upper portion of the sheet discharge roller pair 77 functioning as an inverting roller pair is connected to the discharge and transport path 78. In the duplex transport path 79, disposed are plural duplex transport roller pairs 80 to 83 that transport the inverted recording sheet 6 to the sheet feeding transport path 67, a transport guide member (not shown), and the like.

In the discharge and transport path 75 disposed at the bottom portion of the apparatus main body 2*a*, disposed are plural sheet discharge roller pairs 84 to 88 that directly discharge the recording sheet 6 fed from the sheet feeding device 7 to the second image forming apparatus 3 without an image being formed in the first image forming apparatus 2, a transport guide member (not illustrated), and the like. The discharge and transport roller pair 88 disposed the most downstream of the discharge and transport path 75 in the transport direction of the recording sheet 6 is also a discharge and transport roller pair that discharges the recording sheet 6 on which an image(s) are formed on one side or both sides in the first image forming apparatus 2, to the second image forming apparatus 3.

In FIG. 2, reference numeral 200 denotes a control device of the first image forming apparatus 2.

Operation of First Image Forming Apparatus

Hereinafter, basic image forming operation by the first image forming apparatus 2 will be described.

Here, an image forming operation when a full-color image is formed with a combination of toner images of four colors (Y, M, C, K) using the four image forming devices 20 (Y, M, C, K) will be described.

When the first image forming apparatus 2 receives, from the controller 4, command information requesting the image forming operation (print), the four image forming devices 20 (Y, M, C, K), the intermediate transfer device 30, the secondary transfer device 40, the fixing device 50 are started up by control of the control device 200.

In each of the image forming devices 20 (Y, M, C, K), first, the photoconductor drum 21 rotates in the direction indicated by the arrow A, and the charging device 22 charges the surface of the photoconductor drum 21 to a required potential having a required polarity (negative polarity in the exemplary embodiment 1). Subsequently, the exposure device 23 irradiates the surface of the photoconductor drum 21 after charging, with light emitted based on a signal of an image obtained by converting information on an image input to the first image forming apparatus 2 into the respective color components (Y, M, C, K) to form an electrostatic latent image of the color component on the surface thereof by the required potential difference.

Subsequently, each of the developing devices 24 (Y, M, C, K) performs development by supplying a toner of a corresponding color (Y, M, C, K) charged with the required polarity (negative polarity) to the electrostatic latent image of the corresponding color component formed on the photoconductor drum 21 and causing the toner to electrostatically adhere thereto. The development visualizes the electrostatic latent images of the respective color components formed on the photoconductor drums 21 as toner images of the four colors (Y, M, C, K) developed with the toners of the corresponding colors.

Subsequently, when the toner image of each color formed on the photoconductor drum 21 of each of the image forming devices 20 (Y, M, C, K) is transported to the primary transfer position T1, the primary transfer device 25 performs primary transfer so that the toner images of the respective colors are sequentially superimposed on the intermediate transfer belt 31 of the intermediate transfer device 30 which is rotating in the direction indicated by the arrow B.

In addition, in each of the image forming devices 20 in which the primary transfer has been completed, the drum cleaning device 26 scrapes and removes an adhering matter to thereby clean the surface of the photoconductor drum 21. In this way, each of the image forming devices 20 is ready for the next image formation operation.

Subsequently, the intermediate transfer device 30 holds and transports the toner image that has been primarily transferred thereto to the secondary transfer position T2 by the rotation of the intermediate transfer belt 31. On the other hand, the sheet feeding device 7 feeds the required recording sheet 6 from the sheet accommodating body 701 to the sheet feeding transport path 67 of the first image forming apparatus 2 via the sheet transport path 704 in accordance with the image producing operation. In the sheet feeding transport path 67, the sheet transport roller pair 66 as a registration roller feeds and supplies the recording sheet 6 to the secondary transfer position T2 in accordance with the transfer timing.

At the secondary transfer position T2, the secondary transfer belt 41 collectively secondarily transfers the toner images on the intermediate transfer belt 31 onto the recording sheet 6. In the intermediate transfer device 30 after the secondary transfer is completed, the belt cleaning device 38 removes and cleans the adhering matter such as toner remaining on the surface of the intermediate transfer belt 31 after secondary transfer.

Subsequently, the recording sheet 6 on which the toner image has been secondarily transferred is separated from the intermediate transfer belt 31 and the secondary transfer belt 41 and then is transported to the fixing device 50 by the three sheet transport belts 68*a*, 68*b*, and 68*c* successively arranged. The fixing device 50 performs a necessary fixing process (that is, applies heat and pressure) to fix an unfixed toner image on the recording sheet 6 by introducing and passing the recording sheet 6 after the secondary transfer to the contact portion between the heating rotational body 51 and the pressure applying rotational body 52 that are rotating.

After the fixing process is completed, the recording sheet 6 is discharged to the second image forming apparatus 3 by the sheet discharge roller pairs 77 and 88 via the discharge and transport path 78.

In addition, when images are to be formed on both surfaces of the recording sheet 6 in the first image forming apparatus 2, instead of discharging the recording sheet 6, on one surface of which the image is formed, to the second image forming apparatus 3 by the sheet discharge roller pairs 77 and 88, the recording sheet 6 is inverted, and the switching member (not illustrated) switches the transport path of the recording sheet 6 from the discharge and transport path 78 to the duplex transport path 79. The recording sheet 6 guided to the duplex transport path 79 is transported to the sheet feeding transport path 67 by the plural duplex transport roller pairs 80 to 83, and a toner image is transferred from the intermediate transfer belt 31 to the back surface of the recording sheet 6. Then, the recording sheet 6 is transported to the fixing device 50. The fixing process is performed for (that is, heat and pressure are applied to) the toner image transferred to the back surface of the recording sheet 6 by the fixing device 50. The recording sheet 6 is discharged to the second image forming apparatus 3 through the discharge and transport path 78 by the sheet discharge roller pair 88.

By performing the above operations, a full-color image which is formed using a combination of the toner images of the toner T of the four colors (Y, M, C, K) is formed on one surface or both surfaces of the recording sheet 6. In addition, when plural request commands for the image forming operation are received, the image forming operation is repeated in the same way the number of times equal to the number of received commands. Further, as described above, in addition to the full-color image, an image in which toner images of one to three colors are appropriately combined by forming toner images by one to three image forming devices may be formed on the recording sheet 6 by the same image forming operation.

Configuration of Second Image Forming Apparatus

FIG. 4 is a configuration diagram illustrating the second image forming apparatus 3 of the image forming system 1 according to the exemplary embodiment 1 of the present disclosure.

The second image forming apparatus 3 according to the exemplary embodiment 1 is, for example, a spot color printer. As illustrated in FIG. 4, the second image forming apparatus 3 basically has the same configuration as the first image forming apparatus 2 except that the second image forming apparatus 3 is different in colors of formed toner images from the first image forming apparatus 2. Therefore, the same members are denoted by the same reference numerals, and thus the detailed description thereof will be omitted. The second image forming apparatus 3 includes four image forming devices 20, as examples of a second image forming unit, that forms toner images of spot colors different from each other.

The four image forming devices 20 is roughly classified into an image forming device 20CL that forms a transparent toner image developed with a transparent (CL) toner, an image forming device 200 that forms a toner image developed with an orange (O) toner, an image forming device 20G that forms a toner image developed with a green (G) toner, and an image forming device 20V that forms a toner image developed with a violet (V) toner. These four image forming devices 20 are arranged in a line along the horizontal direction in an internal space of an apparatus main body 3*a*. The image forming device 20CL that forms the transparent toner image is disposed on the most upstream in a moving direction of the intermediate transfer belt 31.

The image forming devices 20 (CL, O, G, V) have the same configuration as the image forming devices 20 (Y, M, C, K) of the first image forming apparatus 2.

Similarly to the first image forming apparatus 2, as the secondary transfer device 40 that is an example of a second transfer unit, a contact-type transfer device is employed that includes belt support rollers 36 supporting the intermediate transfer belt 31 at the secondary transfer position T2 and the secondary transfer belt 41 that rotates while being in contact with the outer peripheral surface of the intermediate transfer belt 31 supported by the belt support rollers 36. The secondary transfer device will be described later in more detail.

Similarly to the first image forming apparatus 2, the second image forming apparatus 3 includes the transport device 60 that transports the recording sheet 6 introduced into the second image forming apparatus 3. The transport device 60 has the same configuration as that of the first image forming apparatus 2. The second image forming apparatus 3 discharges the recording sheet 6, on one surface or both surfaces of which an image(s) are formed in the second image forming apparatus 3, to a discharging and accommodating unit (not illustrated) outside the apparatus main body 3*a*, by the sheet discharge roller pair 88.

In FIG. 4, reference numeral 300 denotes a control device of the second image forming apparatus 3.

Operation of Second Image Forming Apparatus

Image forming operation by the second image forming apparatus 3 is basically the same as that by the first image forming apparatus 2.

When the second image forming apparatus 3 receives, from the controller 4, command information on a request for image forming operation (print) on the recording sheet 6 on which an image has been formed by the first image forming apparatus 2, the second image forming apparatus 3 starts up the four image forming devices 20 (CL, O, G, V), the intermediate transfer device 30, the secondary transfer device 40, the fixing device 50, and the like, under the control of the control device 300.

Then, in at least one of the image forming devices 20 (CL, O, G, V) for the respective colors of transparent (CL), orange (O), green (G), and violet (V), toner images of the respective colors are formed.

Subsequently, when the toner image of the color formed on the photoconductor drum 21 of each of the image forming devices 20 (CL, O, G, V) is transported to the primary transfer position T1, the primary transfer device 25 primarily transfers the toner image of the color to the intermediate transfer belt 31 of the intermediate transfer device 30 that is rotating in the direction indicated by the arrow B.

Subsequently, the intermediate transfer device 30 holds and transports the toner image that has been primarily transferred thereto to the secondary transfer position T2 by the rotation of the intermediate transfer belt 31. On the other hand, the recording sheet 6 on which the image has been formed by the first image forming apparatus 2 is transported to the sheet feeding transport path 67 via the introducing roller pair 61 and the switching member 62. In the sheet feeding transport path 67, the sheet transport roller pair 66 as a registration roller feeds and supplies the recording sheet 6 to the secondary transfer position T2 in accordance with the transfer timing.

At the secondary transfer position T2, the secondary transfer belt 41 collectively secondarily transfers the toner images on the intermediate transfer belt 31 onto the recording sheet 6. In the intermediate transfer device 30 after the secondary transfer is completed, the belt cleaning device 38 removes and cleans the adhering matter such as toner remaining on the surface of the intermediate transfer belt 31 after secondary transfer.

Subsequently, the recording sheet 6 on which the toner image has been secondarily transferred is separated from the intermediate transfer belt 31 and the secondary transfer belt 41 and then is transported to the fixing device 50 by the three sheet transport belts 68*a*, 68*b*, and 68*c* successively arranged. The fixing device 50 performs a necessary fixing process (that is, applies heat and pressure) to fix an unfixed toner image on the recording sheet 6 by introducing and passing the recording sheet 6 after the secondary transfer to the contact portion between the heating rotational body 51 and the pressure applying rotational body 52 that are rotating.

The recording sheet 6 after the fixing process is completed is discharged to the discharging and accommodating unit (not illustrated) provided on a side surface of the second image forming apparatus 3 through the discharge and transport path 78 by the sheet discharge roller pairs 77 and 88.

In addition, when images are formed on both surfaces of the recording sheet 6 in the second image forming apparatus 3, instead of discharging the recording sheet 6, on one surface of which the image is formed, to the discharging and accommodating unit (not illustrated), a switching member (not illustrated) switches the transport path from the discharge and transport path 78 to the duplex transport path 79. In this way, images are formed on both surfaces of the recording sheet 6.

Through the operation performed as described above, a toner image of at least one spot color toner (CL, O, G, V) of transparent (CL), orange (O), green (G) and violet (V) is formed on one surface or both surfaces of the recording sheet 6 on which the full color toner image of the toners of the four colors (Y, M, C, K) is formed. In addition, when plural request commands for the image forming operation are received, the image forming operation is repeated in the same way the number of times equal to the number of received commands.

Configuration of Characteristic Portion of Image Forming System

As illustrated in FIGS. 1 and 2, in the image forming system 1 according to the exemplary embodiment 1, for example, an image of full color, or the like, is formed on the recording sheet 6 in the first image forming apparatus 2, and then an image of spot color toners such as transparent (CL), orange (O), green (G), and violet (V) is formed on the same recording sheet 6 in the second image forming apparatus 3.

Figure 5:
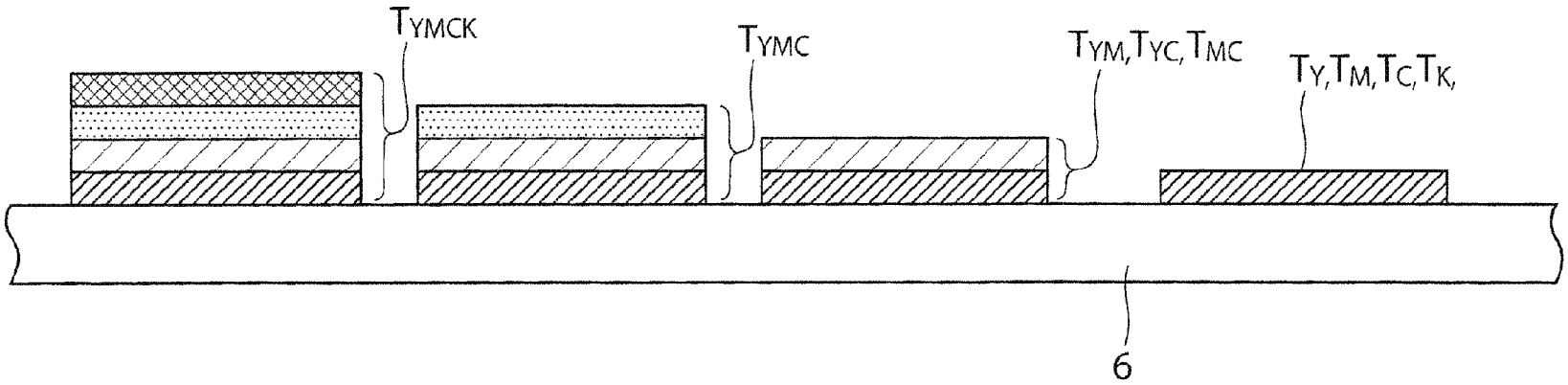
FIG. 5 is a schematic diagram illustrating an image formed on a recording sheet by the first image forming apparatus.

As described above, in the second image forming apparatus 3, the image of the spot color toners such as transparent (CL), orange (O), green (G), and violet (V) is formed on the recording sheet 6 on which the image of the full color, or the like, has been formed in the first image forming apparatus 2, instead of an unused recording sheet 6. Therefore, as illustrated in FIG. 5, various toner images are present on the recording sheet 6 on which an image is to be formed with the spot color toners in the second image forming apparatus 3. In FIG. 5, the various toner images include a single color image having each of toner images $T_Y$, $T_M$, $T_C$ and $T_K$ of yellow (Y), magenta (M), cyan (C) and black (K) colors, a double color image in which toner images $T_{YM}$, $T_{YC}$, and $T_{MC}$ of two colors of yellow (Y), magenta (M), cyan (C), and black (K) are superimposed, a triple color image in which toner images $T_{YMCK}$ of three colors of yellow (Y), magenta (M), and cyan (C) are superimposed, and a quadruple color image in which toner images $T_{YMCK}$ of the four colors of yellow (Y), magenta (M), cyan (C) and black (K) are superimposed. In addition, a plain region is also present on the recording sheet 6 on which the image is to be formed with the spot color toners in the second image forming apparatus 3. In the plain region, no toner image of yellow (Y), magenta (M), cyan (C), or black (K) is formed. In addition, normally, the quadruple color image in which toner images $T_{YMCK}$ of the four colors of yellow (Y), magenta (M), cyan (C) and black (K) are superimposed may be present in a case of some other color image than black, even though this is a rare case.

The toner of each of yellow (Y), magenta (M), cyan (C), and black (K) colors formed on the recording sheet 6 contains a binder resin, a coloring agent of each color, and a releasing agent. Various kinds of binder resins may be used, such as non-vinyl resins including a polyester resin, an epoxy resin, a polyurethane resin, a polyamide resin, a cellulose resin, a polyether resin, modified rosin, and the like, mixtures of non-vinyl resins with vinyl resins, or graft polymers obtained by polymerizing vinyl monomers under the coexistence thereof. Among others, polyester resins are preferably used. The toner contains a coloring agent, a releasing agent and the like in addition to the binder resin, but is mainly formed of the binder resin. The volume resistivity of the toner is, for example, approximately $10^{13}$ to $10^{14}$ Ω·cm.

In addition, the recording sheet 6 on which a toner image T is to be formed is generally an insulator, and has a surface electric resistance of approximately $10^{10}$ to $10^{12}$Ω (humidity 50% to 60%). As the recording sheet 6, for example, high-quality paper with a basis weight of approximately 80 g/m$^2$ is used.

Accordingly, on the recording sheet 6 on which an image is to be formed by the second image forming apparatus 3, a single-color image to a four-color image of toners which are yellow (Y), magenta (M), cyan (C), and black (K) colors and have the volume resistivity of approximately $10^{13}$ to $10^{14}$ Ω·cm are present as compared with a case in which an image is to be formed by the first image forming apparatus 2.

When the secondary transfer device 40 in the second image forming apparatus 3 has the same configuration as the secondary transfer device 40 in the first image forming apparatus 2, it is concerned that transferability of an image of the spot color toners to be transferred to the recording sheet 6 may be reduced due to the single-color image to the four-color image which are already present on the recording sheet 6 as illustrated in FIG. 5 and which have the volume resistivity of approximately $10^{13}$ to $10^{14}$ Ω·cm.

Therefore, in the exemplary embodiment 1, the following secondary transfer device is provided. The secondary transfer device transfers an image formed in the second image forming apparatus 3 to the recording sheet 6 on which an image has been formed by the first image forming apparatus 2. A total resistance of the secondary transfer device along a direction in which a transfer current flows (hereinafter which may be referred to as a "system resistance") is larger than that of the secondary transfer device of the first image forming apparatus 2. The secondary transfer device is an example of a second transfer unit.

Here, the system resistance refers to a combined resistance that is a total resistance of a member constituting the secondary transfer device 40 along the direction in which the transfer current flows.

At this time, the second transfer unit has, for example, a system resistance approximately 10 to 20 times larger than that of the first transfer unit. The secondary transfer device 40 of the first image forming apparatus 2 normally has a system resistance of approximately several MΩ to tens of MΩ. On the other hand, the secondary transfer device 40 of the second image forming apparatus 3 has a system resistance of approximately one hundred MΩ to hundreds of MΩ.

In addition, in the exemplary embodiment 1, the transfer power supply of the first transfer unit is constant-current-controlled, and the transfer power supply of the second transfer unit is constant-voltage-controlled.

Further, in the exemplary embodiment 1, the transfer power supply of the second transfer unit applies a voltage 2 to 2.5 times larger than that the transfer power supply of the first transfer unit applies. In the secondary transfer device 40 of the first image forming apparatus 2, a secondary transfer bias voltage is normally approximately 1000 to 1500 V. On the other hand, in the secondary transfer device 40 of the second image forming apparatus 3, a secondary transfer bias voltage is approximately 2000 to 3500 V.

Configuration of Secondary Transfer Device

Figure 6:
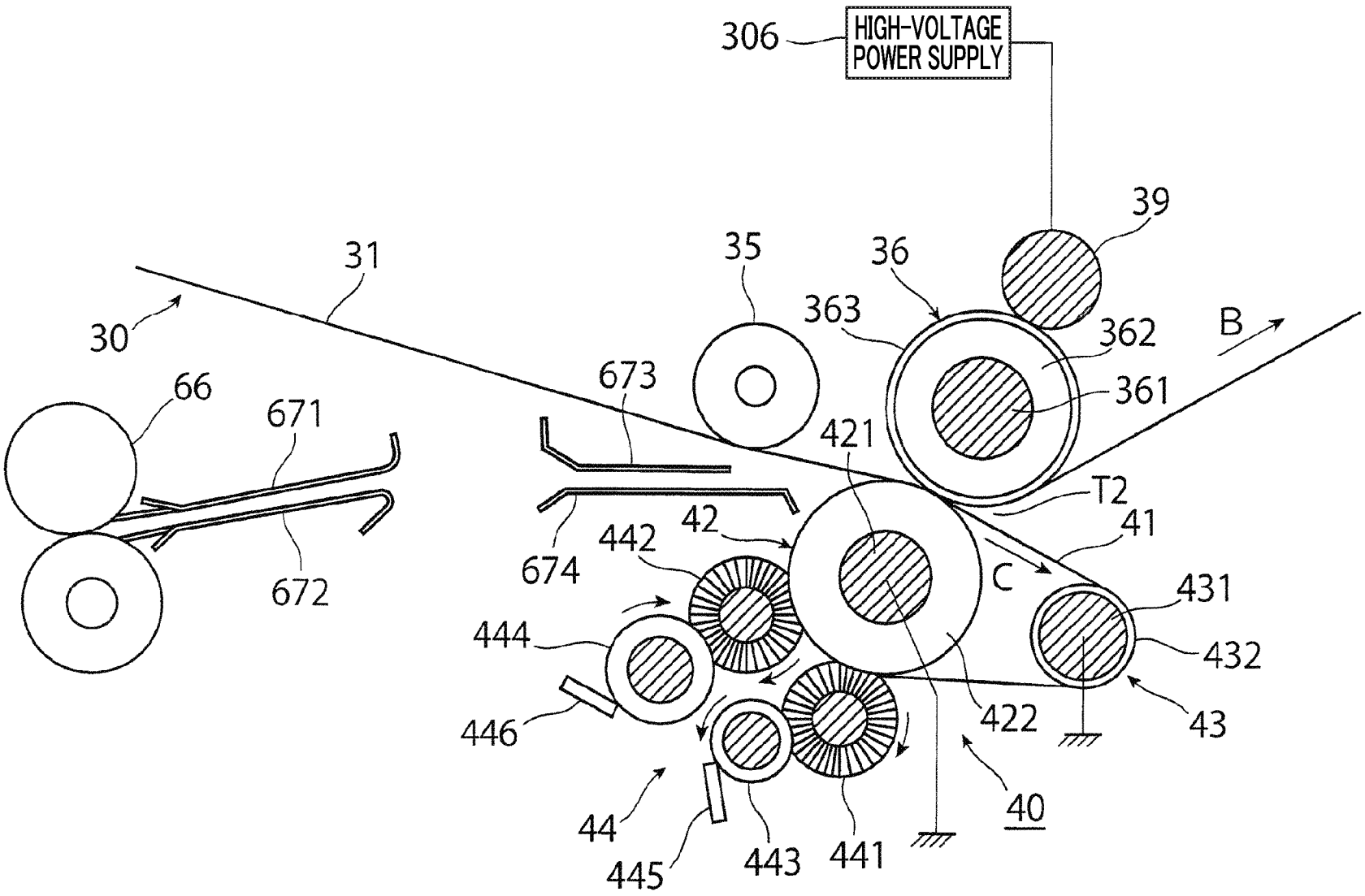
FIG. 6 is a configuration diagram illustrating secondary transfer devices of the first and second image forming apparatuses.

FIG. 6 is a configuration diagram illustrating secondary transfer devices of the first and second image forming apparatuses according to the exemplary embodiment 1 of the present disclosure. The first and second image forming apparatuses basically have the same configuration except for some physical properties such as resistance values of members constituting the secondary transfer device. Here, the secondary transfer device 40 of the second image forming apparatus 3 will be described as an example.

As illustrated in FIG. 6, the secondary transfer device 40 mainly includes the belt support roller 36 that supports the intermediate transfer belt 31 from the back surface thereof at the secondary transfer position T2, the secondary transfer belt 41 as an example of an endless belt that circularly moves in the direction indicated by an arrow C while passing through the secondary transfer position T2, plural belt support rollers 42 and 43 (two belt support rollers in the illustrated exemplary embodiment) that hold the secondary transfer belt 41 in a desired state from the inner periphery of the secondary transfer belt 41 to rotatably support the secondary transfer belt 41, and a belt cleaning device 44 that removes and cleans up adhering matters such as toner and paper dust remaining on and adhering to the outer peripheral surface of the secondary transfer belt 41. In FIG. 6, reference numerals 671 to 674 indicate sheet guide members that guide the recording sheet 6 to the secondary transfer position T2, respectively.

For example, the secondary transfer belt 41 is formed by dispersing a resistance modifier, such as carbon black and an ionic conductive agent, in a rubber material, such as an ethylene-propylene-diene copolymer rubber (EPDM), an acrylonitrile-butadiene copolymer rubber (NBR) and an epichlorohydrin rubber-ethylene oxide copolymer rubber (ECO), to have a required resistance value, and coating a front and/or back surface thereof with a coating layer containing a fluororesin.

The secondary transfer belt 41 may have approximately 350 to 700 μm in thickness, 280 to 340 mm in width, and 120 to 400 mm in circumferential length.

In the exemplary embodiment 1, the secondary transfer belt 41 of the first image forming apparatus 2 has the volume resistance of approximately 6.5 to 7.5 Log Ω.

On the other hand, the secondary transfer belt 41 of the second image forming apparatus 3 has the volume resistance of approximately 8.0 to 9.5 Log Ω. The secondary transfer belt 41 of the second image forming apparatus 3 has a volume resistivity approximately 10 to 100 times larger than that of the first image forming apparatus 2.

Here, the "volume resistance" refers to a value obtained by dividing a voltage V by a current I where the current I is a current flowing when the voltage V of 500 V is applied while the secondary transfer belt 41 is pinched by two metal rollers having an outer diameter of 28 mm and a length of 300 mm with one of the metal rollers pressing the outside surface of the belt 41 and the other metal roller pressing the inside surface thereof, each with a load of 1 kg.

The belt support roller 42 functioning as a driving roller may be a secondary transfer roller that is in contact with the intermediate transfer belt 31 through the secondary transfer belt 41 at the secondary transfer position T2. The secondary transfer roller 42 is so called a sponge roller having a core metal 421 made of metal such as stainless steel, iron (free-cutting steel and the like), aluminum or the like, and a foamable elastic layer 422 coated on the outer periphery of the core metal 421 with adjusted resistivity. The core metal 421 of the secondary transfer roller 42 functions as a rotating shaft.

For example, the elastic layer 422 of the secondary transfer roller 42 is formed by dispersing a resistance modifier, such as carbon black and ionic conductive agents, in a foamable rubber material, such as an ethylene-propylene-diene copolymer rubber (EPDM), an acrylonitrile-butadiene copolymer rubber (NBR), an epichlorohydrin rubber-ethylene oxide copolymer rubber (ECO), or a mixture thereof, to have a required resistance value.

The secondary transfer roller 42 is formed such that the core metal 421 has an outer diameter of approximately 12 to 16 mm and the elastic layer 422 has an outer diameter of approximately 20 to 28 mm. In addition, in the secondary transfer roller 42 of each of the first and second image forming apparatuses 2 and 3, a nip portion resistance of the elastic layer 422 is 1 MΩ or less.

Here, the "nip portion resistance" refers to a value obtained from a current when a load of 500 g is applied to the secondary transfer roller 42 and a voltage of 100V (10-second charge) is applied to the secondary transfer roller 42, and measurement is performed in such a manner that a metal plate such as SUS is brought into contact therewith and the nip portion thereof is measured.

The belt support roller 43 functioning as a driven roller and a separation roller includes a support shaft 431 made of metal such as stainless steel, iron (free-cutting steel and the like), aluminum, or the like, and plural cylindrical members 432 rotatably supported on the outer periphery of the support shaft 431 and rotatably supporting a winding portion of the secondary transfer belt 41. The belt support roller 43 has an outer diameter smaller than that of the secondary transfer roller 42. The core metal 421 of the secondary transfer roller 42 and the support shaft 431 of the belt support roller 43 are both connected to the ground.

On the other hand, the belt support roller 36 includes a core metal 361 made of metal such as stainless steel, iron (such as free-cutting steel and the like), aluminum, or the like, an insulating layer 362 relatively thickly coated on the outer periphery of the core metal 361, and a semi-conductive layer 363 that is coated on the outer periphery of the insulating layer 362 and that is very thinner than the insulating layer 362. A power supply roller 39 made of metal is in contact with the outer peripheral surface of the belt support roller 36 and applies a secondary transfer voltage to the belt support roller 36. The secondary transfer bias is applied to the power supply roller 39 by a high-voltage power supply 306 as a secondary transfer bias power supply.

The high-voltage power supply 306 of the first image forming apparatus 2 applies a required secondary transfer bias current of negative polarity under constant current control. The high-voltage power supply 306 of the first image forming apparatus 2 is constant-current-controlled. Therefore, the high-voltage power supply 306 of the first image forming apparatus 2 normally outputs a DC voltage of approximately 1.0 to 1.5 kV, although the output voltage may vary depending on the set current value and the system resistance of the secondary transfer device 40.

On the other hand, the high-voltage power supply 306 of the second image forming apparatus 3 applies a required secondary transfer bias voltage of negative polarity under constant-voltage-control. The high-voltage power supply 306 of the second image forming apparatus 3 applies, for example, a DC voltage of approximately 2.0 to 3.5 kV, which is 2 to 2.5 times larger than that the first image forming apparatus 2 applies, as a secondary transfer bias voltage.

The insulating layer 362 of the belt support roller 36 may be formed, for example, of a foamable rubber material, such as, an ethylene-propylene-diene copolymer rubber (EPDM), an acrylonitrile-butadiene copolymer rubber (NBR), an epichlorohydrin rubber-ethylene oxide copolymer rubber (ECO), or a mixture thereof.

In addition, the semi-conductive layer 363 of the belt support roller 36 is configured to have a required resistance value by dispersing a resistance modifier, such as carbon black and an ionic conductive agent, in a rubber material, such as an ethylene-propylene-diene copolymer rubber (EPDM), an acrylonitrile-butadiene copolymer rubber (NBR) and an epichlorohydrin rubber-ethylene oxide copolymer rubber (ECO) and a mixture thereof.

The belt support roller 36 is formed such that the core metal 361 has an outer diameter of approximately 12 to 16 mm and the insulating layer 362 has an outer diameter of approximately 20 to 28 mm. In addition, the semi-conductive layer 363 of the belt support roller 36 has a thickness of approximately 0.5 mm.

In the exemplary embodiment 1, the semi-conductive layer 363 of the belt support roller 36 of the first image forming apparatus 2 may have the surface resistivity of 6.5 to 7.5 Log Ω/□.

On the other hand, the semi-conductive layer 363 of the belt support roller 36 of the second image forming apparatus 3 may have the surface resistivity of 7.0 to 8.0 Log Ω/□.

The surface resistivity $\mu_R$ (Ω/□) of the semi-conductive layer 363 of the belt support roller 36 is obtained in the following manner. That is, at 23 degrees Celsius and 55% RH, two SUS metal rollers that are separated by 10 mm in the circumferential direction, that has a diameter of 12 mm, and that are longer than the belt support roller 36, for example, has a length of 330 mm are brought into contact with the surface of the semi-conductive layer 363 of the belt support roller 36 with a biting amount of 0.2 mm, a DC voltage (V) of 1 kV is applied between the metal rollers, and a current value (I) is measured 10 seconds after the voltage application. The surface resistivity $\mu_R$ (Ω/□) is obtained using the equation below.

$$\mu_R(\Omega/\square)=LV/GI$$

where L represents the length (cm) of the belt support roller 36, and G represents the distance (cm) between the two metal rollers that is measured along the surface of semi-conductive layer 363 of belt support roller 36.

The belt cleaning device 44 includes bias brushes 441 and 442 each having a metallic core metal coated with a conductive brush, detoning rollers 443 and 444 each having a metallic core metal coated with a semi-conductive layer, and scrapers 445 and 446 disposed on the surfaces of the detoning rollers 443 and 444, respectively.

In the exemplary embodiment, belt cleaning devices 44 are provided in a pair, one of the two is a positive electrode and the other is a negative electrode. In the belt cleaning device 44 for the positive electrode, a cleaning potential of positive polarity is applied to the bias brush 441. A cleaning potential of the positive polarity that is slightly higher than that applied to the bias brush 441 is applied to the detoning roller 443. In addition, in the belt cleaning device 44 for the negative electrode, a cleaning potential of negative polarity is applied to the bias brush 442, and a cleaning potential of negative polarity that is slightly lower than that applied to the bias brush 442 is applied to the detoning roller 444.

The conductive brushes of the bias brushes 441 and 442 are formed by dispersing or coating a conductive material such as carbon black in fibers such as polyester or rayon. In addition, the detoning rollers 443 and 444 may be those obtained by dispersing a conductive material such as carbon black in a thermoplastic resin such as a phenol resin or an epoxy resin, or by sealing the surface of an aluminum roller treated with alumite (anodized film) with a fluororesin or the like in which a conductive material is dispersed. Each of the scrapers 445 and 446 is a thin plate such as stainless steel or phosphor bronze.

In each of the bias brushes 441 and 442, the metallic core metal has an outer diameter of approximately 8 mm and the brush has an outer diameter of approximately 17 mm. Each of the detoning rollers 443 and 444 has a shaft of 10 mm and an outer diameter of approximately 10 mm. Each of the scrapers 445 and 446 has a thickness of approximately 100 μm.

In both the first and second image forming apparatuses 2 and 3, the bias brushes 441 and 442 have resistance values of 6.0 to 6.5 Log Ω, and the detoning rollers 443 and 444 have resistance values of approximately 7.0 to 7.7 Log Ω.

Operation of Image Forming System

In the exemplary embodiment 1, transferability when an image is transferred in the second image forming apparatus to a recording medium on which an image has been formed by the first image forming apparatus is improved in a manner described below as compared with a case where the total resistance of the transfer unit in the second image forming apparatus along the direction in which the transfer current flows is equal to or less than the total resistance of the transfer unit in the first image forming apparatus.

That is, as illustrated in FIG. 1, in the image forming system 1 according to the exemplary embodiment 1, for example, an image of full-color or the like is formed on the recording sheet 6 in the first image forming apparatus 2, and then an image of the spot color toners such as transparent (CL), orange (O), green (G), and violet (V) is formed on the same recording sheet 6 in the second image forming apparatus 3.

Therefore, as illustrated in FIG. 5, various images are present on the recording sheet 6 on which an image of the spot color toners is to be formed in the second image forming apparatus 3, as well as a region where no toner image of yellow (Y), magenta (M), cyan (C), and black (K) is formed. The various images may include a single-color image to a four-color image of yellow (Y), magenta (M), cyan (C), and black (K) toners.

Figure 7A:
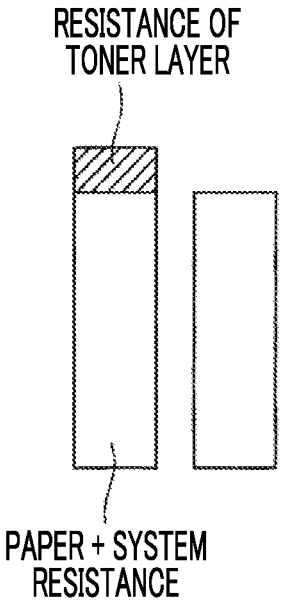
FIGS. 7A and 7B are explanatory diagrams illustrating a characteristic portion of the image forming system according to the exemplary embodiment 1 of the present disclosure.
Figure 7B:
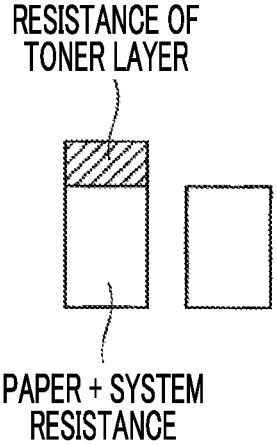

The toner of each of yellow (Y), magenta (M), cyan (C), and black (K) has a volume resistivity of approximately $10^{13}$ to $10^{14}$ of Ω·cm. As a result, when a toner image of the spot color toners such as transparent (CL), orange (O), green (G), violet (V), and the like, formed on the intermediate transfer belt 31 is secondarily transferred in the second image forming apparatus 3, the resistance values of the recording sheet 6 and the toner image T greatly vary depending on how much the fixed toner image T is present on the recording sheet 6, as illustrated in FIGS. 7A and 7B.

The secondary transfer electric field E acting on the toner image on the intermediate transfer belt 31 is expressed as follows:

$$E=V/\varepsilon_0\Sigma\varepsilon_i D_i$$

where V is a potential difference between the voltage applied by the power supply roller 39 and the ground potential, $\Sigma\varepsilon_i D_i$ is the total dielectric thickness of layers constituting the secondary transfer nip ($D_1$: dielectric thickness of the belt support roller 36, $D_2$: dielectric thickness of the intermediate transfer belt 31, $D_3$: dielectric thickness of a gap layer, $D_3$: dielectric thickness of the toner on the intermediate transfer belt 31, $D_4$: dielectric thickness of toner fixed on the recording sheet 6, $D_5$: dielectric thickness of the recording sheet 6. $D_6$: dielectric thickness of the secondary transfer belt 41, and $D_7$: dielectric thickness of the secondary transfer roller 42), and $\varepsilon_i$ is a relative permittivity of a dielectric constituting dielectric thickness $D_i$.

As a result, the secondary transfer electric field E acting on the toner image on the intermediate transfer belt 31 largely varies depending on the dielectric thickness $D_4$ of the toner fixed on the recording sheet 6, as understood from the above equation.

Figure 8:
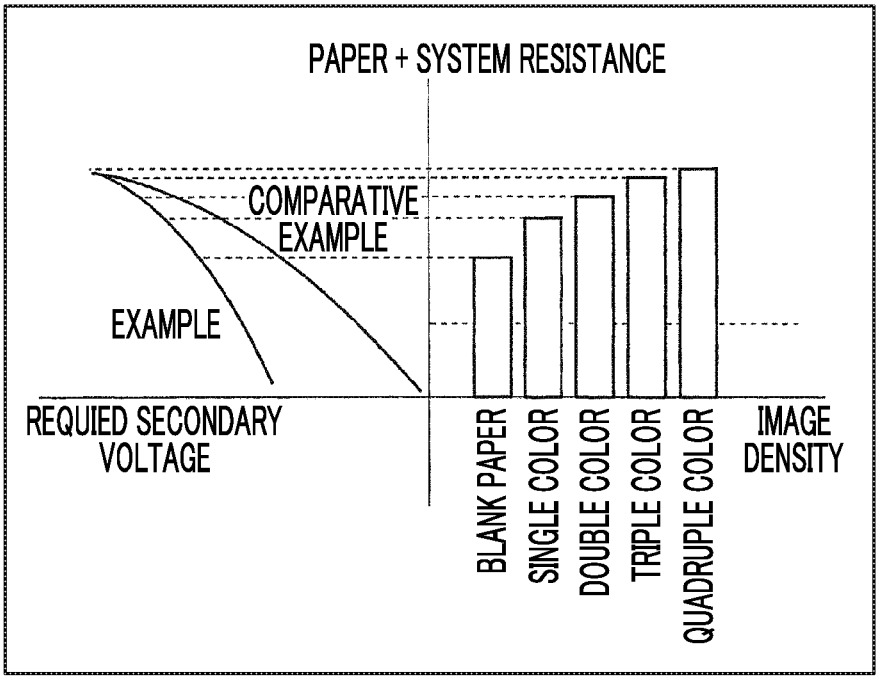
FIG. 8 is a graph illustrating operations of the image forming system according to the exemplary embodiment 1 of the present disclosure.

FIG. 8 is a schematic diagram illustrating, in a graph form, secondary transfer voltages that are required according to how much a toner image is present on the recording sheet 6, that is, (i) a blank sheet where the recording sheet 6 alone, (ii) a single color image in which a single layer of a toner image is present on the recording sheet 6, (iii) a double color image in which two layers of toner images are present on the recording sheet 6, (iv) a triple color image in which three layers of toner images are present on the recording sheet 6, and (v) a quadruple color image in which four layers of toner images are present on the recording sheet 6, when the toner image is secondarily transferred from the intermediate transfer belt 31 in the second image forming apparatus 3.

As can be seen from FIG. 8, in the image forming system 1 according to the exemplary embodiment 1, the system resistance of the secondary transfer device 40 of the second image forming apparatus 3 is larger than that of the secondary transfer device 40 of the first image forming apparatus 2.

Therefore, in the secondary transfer device 40 of the second image forming apparatus 3, the secondary transfer voltage required to secondarily transfer the toner image from the intermediate transfer belt 31 is higher than that of the secondary transfer device 40 of the first image forming apparatus 2 which is illustrated as a comparative example, the slope of the curve indicating the secondary transfer voltage required to transfer the blank sheet to the quadruple color image on the recording sheet 6 is larger than that of the first image forming apparatus 2, and the value of the secondary transfer voltage at which the curve indicating the secondary transfer voltage rises is large.

Therefore, in the secondary transfer device 40 of the second image forming apparatus 3, the region of the secondary transfer voltage required to transfer the blank sheet to the quadruple color image from the intermediate transfer belt 31 on the recording sheet 6 is narrow, and it is possible to set the secondary transfer voltage to a value required to secure transferability of the blank sheet to the quadruple color image on the recording sheet 6 from the intermediate transfer belt 31.

Therefore, in the image forming system 1 according to the exemplary embodiment 1, it is possible to improve the transferability when the image is transferred by the second image forming apparatus 3 to the recording sheet 6 on which the image has been formed by the first image forming apparatus 2 as compared with the case where the system resistance of the secondary transfer device 40 in the second image forming apparatus 3 along the direction in which the transfer current flows is equal to or lower than the system resistance of the secondary transfer device 40 in the first image forming apparatus 2.

Experimental Example

Next, the present inventor makes a prototype of the second image forming apparatus 3 illustrated in FIG. 3, and conducts an experiment to confirm how the transfer rate of toner images transferred to the recording sheet 6 changes when the volume resistivity of the secondary transfer belt 41 constituting the secondary transfer device 40 and the surface resistance value of the belt support roller 36 are set to values larger than those of the first image forming apparatus 2.

Here, the secondary transfer device 40 of the second image forming apparatus 3 is used in which the volume resistance of the secondary transfer belt 41 is 9.0 Log Ω, and the surface resistivity of the semi-conductive layer 363 of the belt support roller 36 is 7.5 Log Ω/□. Except for the above, the secondary transfer devices 40 of the first and second image forming apparatuses 2 and 3 are configured in the same manner.

In addition, the transfer rate of the secondary transfer device 40 of the second image forming apparatus 3 is substituted for the transfer rate of the recording sheet 6 by preparing the recording sheet 6 on which three types of images having large, medium, and small layer thickness of toner images have been formed, and measuring the image density after fixing when the image having the large layer thickness of the toner image is transferred to the recording sheet 6 in the second image forming apparatus 3.

Figure 9:
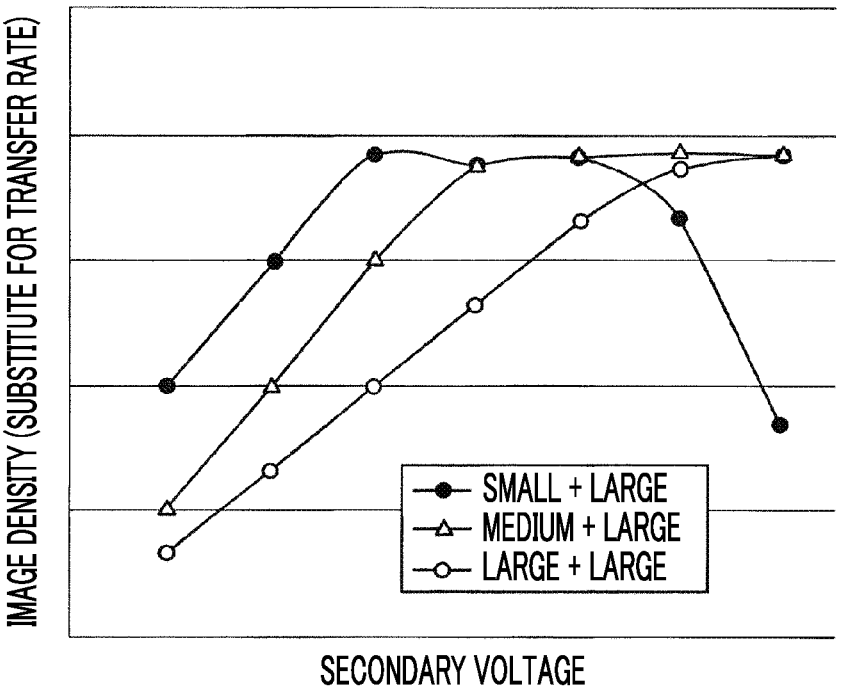
FIG. 9 is a graph illustrating results of experimental examples.

FIG. 9 is a graph illustrating the results of the experimental example.

As apparent from FIG. 9, the results of the experimental example show that when the secondary transfer voltage applied to the secondary transfer device 40 changes, in a case where the layer thickness of the toner image that has been formed on the recording sheet 6 is small, the image density increases with increase in the secondary transfer voltage, and as the secondary transfer voltage reaches a certain level, high image density is maintained, and then, as the secondary transfer voltage further increases, the image density drops sharply.

In addition, the results of the experimental example show that in a case where the layer thickness of the toner image that has been formed on the recording sheet 6 is medium, the secondary transfer voltage at which the image density starts to rise is high as compared with the case where the layer thickness of the toner image is small, and as the secondary transfer voltage reaches a certain value, the high image density continues to be maintained.

Furthermore, in a case where the layer thickness of the toner image that has been formed on the recording sheet 6 is large, the secondary transfer voltage at which the image density starts to rise is further high as compared with the case where the layer thickness of the toner image is medium, and as the secondary transfer voltage reaches a certain high value, the image density also continues to be maintained at a high value.

As described above, the results of the experimental example show that the results of the experimental example show that when the secondary transfer voltage applied to the secondary transfer device 40 is set to a relatively high voltage value, a region is present where good transferability is secured and the image density is high with respect to any of the recording sheets 6 on which three types of images having large, medium, and small layer thickness of the toner images have been formed.

Comparative Example

In addition, the present inventor makes a prototype of the secondary transfer device 40 of the second image forming apparatus 3 so as to be the same as the first image forming apparatus 2 as a comparative example, and conducts an experiment to confirm how the transfer rate of toner images transferred to the recording sheet 6 changes.

Figure 10:
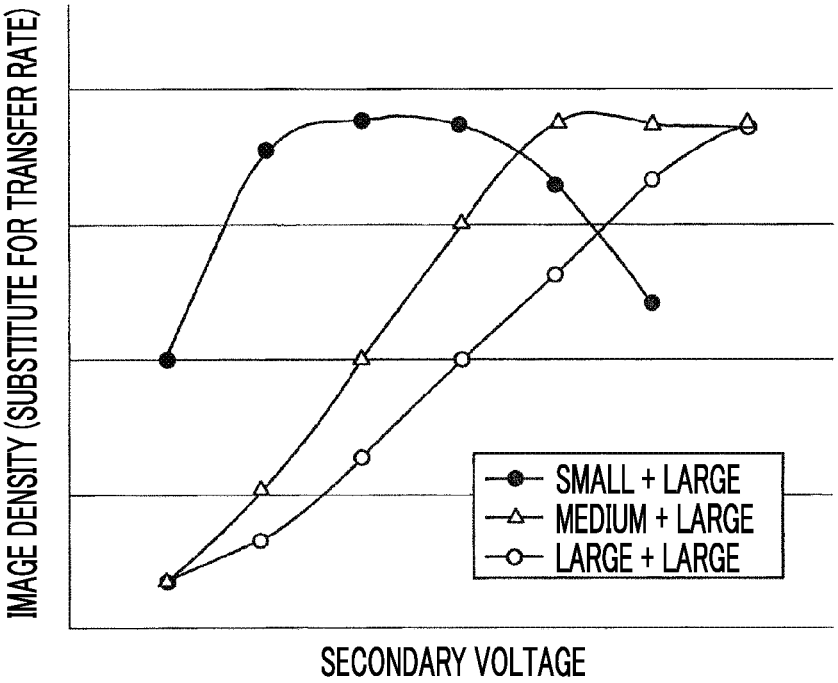
FIG. 10 is a graph illustrating results of comparative examples.

FIG. 10 is a graph illustrating the results of the comparative example.

As apparent from FIG. 10, the results of the comparative example show that when the secondary transfer voltage applied to the secondary transfer device 40 of the second image forming apparatus 3 is changed, in a case where the layer thickness of the toner image that has been formed on the recording sheet 6 is small, the image density increases with increase in the secondary transfer voltage, and as the secondary transfer voltage reaches a certain level, the high image density is maintained, but as the secondary transfer voltage increases, the image density drops shapely at a lower secondary transfer voltage than that in experimental example.

In addition, the results of the comparative example show that in a case where the layer thickness of the toner image that has been formed on the recording sheet 6 is medium, the secondary transfer voltage at which the image density starts to rise is high as compared with the case where the layer thickness of the toner image is small, and as the secondary transfer voltage reaches a certain value, the high image density continues to be maintained.

Furthermore, the results of the comparative example show that in a case where the layer thickness of the toner image that has been formed on the recording sheet 6 is large, the secondary transfer voltage at which the image density starts to rise is further high as compared with the case where the layer thickness of the toner image is medium, and the image density continues to be increased until the secondary transfer voltage reaches a very high value.

As described above, the results show that in the comparative example, even though the secondary transfer voltage applied to the secondary transfer device 40 is changed, a region is not present where good transferability is secured and the image density is high, in any of the recording sheets 6 on which three types of images having large, medium, and small layer thickness of the toner images have been formed, and that good transferability is not obtained in the second image forming apparatus 3 from a blank state to a multi-layer-image formed state of the recording sheet 6.

Exemplary Embodiment 2

Figure 11:
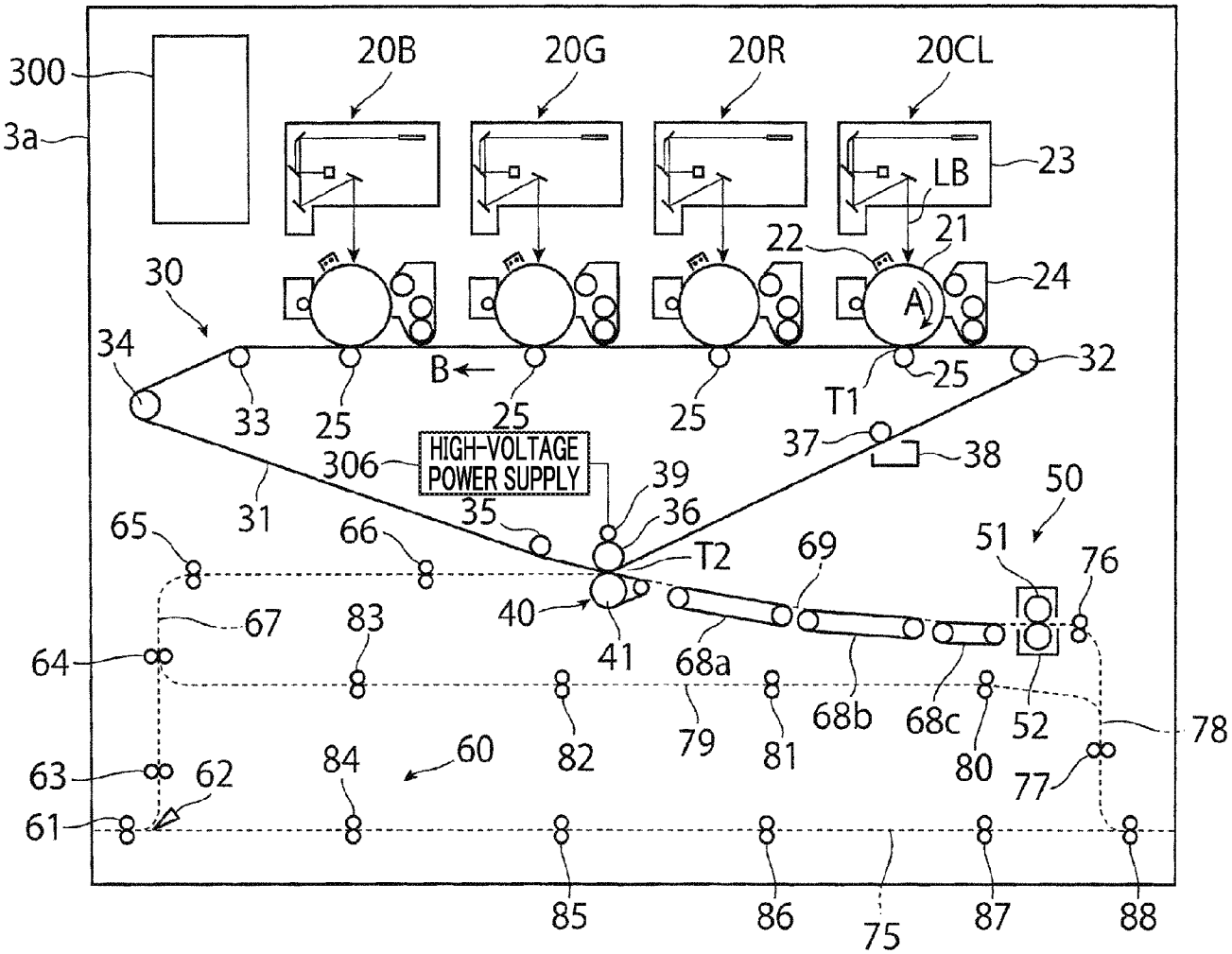
FIG. 11 is a configuration diagram illustrating a second image forming apparatus of an image forming system according to an exemplary embodiment 2 of the present disclosure.

FIG. 11 illustrates an image forming system according to an exemplary embodiment 2.

The image forming system 1 according to the exemplary embodiment 2 is configured such that colors of an image formed by a second image forming apparatus 3 are different from those in the exemplary embodiment 1.

That is, the second image forming apparatus 3 according to the exemplary embodiment 2 includes four image forming devices 20, specifically, an image forming device 20CL forming a transparent toner image developed by a transparent (CL) toner, an image forming device 20R forming a toner image developed by a toner of red (R) color, an image forming device 20G forming a toner image developed by a toner of green (G) color, and an image forming device 20B forming a toner image developed by a toner of blue (B) color.

In image forming devices 20 (R, G, B) of red (R), green (G), and blue (B), among image forming devices 20 (CL, R, G, B) of transparent (CL), red (R), green (G), and blue (B) colors, in many cases, an image may be formed on a recording sheet 6, on which an image of full color has been formed in a first image forming apparatus 2, by using red (R), green (G), and blue (B), alone or in combination.

As described above, in the image forming system 1 according to the exemplary embodiment 2, the toner image of custom colors such as red (R), green (G), and blue (B) can be favorably transferred to the recording sheet 6 on which an image of full color or the like is formed by the first image forming apparatus 2, and an image based on various colors can be formed.

Further, the image formed by the second image forming apparatus 3 is not limited to transparent (CL), red (R), green (G), and blue (B). The image may be formed using a process color such as magenta or cyan formed by the first image forming apparatus 2 or the like, such as light magenta, light cyan, and light blue, or a toner having a lower density than custom color toner.

Since other configurations and functions are the same as the above exemplary embodiments, description thereof will be omitted.

Furthermore, in the above exemplary embodiments, although the configuration has been provided in which the secondary transfer roller 42 is grounded and the required secondary transfer bias voltage with negative polarity is applied to the belt support roller 36, where the negative polarity is the same as the charging polarity of the toner, the present disclosure is not limited thereto. A configuration may be provided in which the belt support roller 36 is grounded, and a required secondary transfer bias voltage with positive polarity is applied to the secondary transfer roller 42, where the positive polarity is opposite to the charging polarity of the toner.

In addition, in the above exemplary embodiments, although the case in which the recording medium is the recording sheet made of a high quality sheet has been described, the recording medium may be made of other materials. In this case, the secondary transfer bias voltage may be set to a different value depending on the material of the recording medium, or the like.

The foregoing description of the exemplary embodiments of the present disclosure has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming system comprising:
a first image forming apparatus comprising:
a first image forming unit configured to form a first image of at least one color, and
a first transfer unit configured to transfer the first image formed by the first image forming unit to a recording medium; and
a second image forming apparatus comprising:
a second image forming unit configured to form a second image having at least one color that is different from any color of the first image, and
a second transfer unit configured to transfer the second image formed by the second image forming unit to the recording medium on which the first image has been formed by the first image forming apparatus,
wherein a total resistance of the second transfer unit along a direction in which a transfer current flows is larger than that of the first transfer unit,
wherein a transfer power supply of the first transfer unit is constant-current-controlled, and
wherein a transfer power supply of the second transfer unit is constant-voltage-controlled.

2. The image forming system according to claim 1, wherein the transfer power supply of the second transfer unit applies a voltage 2 to 2.5 times larger than that the transfer power supply of the first transfer unit applies.

3. The image forming system according to claim 1, wherein the first image forming unit is configured to form images of plural process colors, and
wherein the second image forming unit is configured to form images of plural spot colors.

4. The image forming system according to claim 3, wherein the first image forming unit is configured to form the images of yellow, magenta, cyan and black, and
wherein the second image forming unit is configured to form the images of the spot colors including orange, green and violet.

5. The image forming system according to claim 1, wherein the second transfer unit has the total resistance ten times or more than that of the first transfer unit.

6. The image forming system according to claim 1, wherein the second transfer unit has the total resistance ten times or more than that of the first transfer unit.

7. The image forming system according to claim 2, wherein the second transfer unit has the total resistance ten times or more than that of the first transfer unit.

8. The image forming system according to claim 3, wherein the second transfer unit has the total resistance ten times or more than that of the first transfer unit.

9. The image forming system according to claim 4, wherein the second transfer unit has the total resistance ten times or more than that of the first transfer unit.

10. The image forming system according to claim 1, wherein the first transfer unit and the second transfer unit each comprises a transfer belt wound on plural rollers.

11. The image forming system according to claim 10, wherein a volume resistivity of the transfer belt of the second transfer unit is larger than that of the transfer belt of the first transfer unit.

12. An image forming system comprising:
a first image forming apparatus comprising:
a first image forming means for forming a first image of at least one color, and
a first transfer means for transferring the first image formed by the first image forming unit to a recording medium; and
a second image forming apparatus comprising:
a second image forming means for forming a second image having at least one color that is different from any color of the first image, and
a second transfer means for transferring the second image formed by the second image forming means to the recording medium on which the first image has been formed by the first image forming apparatus,
wherein a total resistance of the second transfer means along a direction in which a transfer current flows is larger than that of the first transfer means,
wherein a transfer power supply of the first transfer means is constant-current-controlled, and wherein a transfer power supply of the second transfer means is constant-voltage-controlled.

13. An image forming system comprising:

a first image forming apparatus comprising:

a first image forming device comprising:

a first photoconductor drum;

a first developer;

a first exposure device; and a first charger configured to charge a peripheral surface of the first photoconductor drum, wherein the first image forming device is configured to form a first image of at least one color, and a first transfer device comprising a first transfer belt, wherein the first transfer device is configured to transfer the first image formed by the first image forming device to a recording medium; and a second image forming apparatus comprising:

a second image forming device comprising:

a second photoconductor drum;

a second developer;

a second exposure device; and a second charger configured to charge a peripheral surface of the second photoconductor drum, wherein the second image forming device is configured to form a second image having at least one color that is different from any color of the first image, and a second transfer device comprising a second transfer belt, wherein the second transfer device is configured to transfer the second image formed by the second image forming device to the recording medium on which the first image has been formed by the first image forming apparatus, wherein a total resistance of the second transfer device along a direction in which a transfer current flows is larger than that of the first transfer device, wherein a transfer power supply of the first transfer device is constant-current-controlled, and wherein a transfer power supply of the second transfer device is constant-voltage-controlled.

* * * * *